US007813692B2

(12) United States Patent
Nakatake

(10) Patent No.: US 7,813,692 B2
(45) Date of Patent: Oct. 12, 2010

(54) WASTE-TONER CONVEYING DEVICE, CLEANING DEVICE, AND PROCESS CARTRIDGE

(75) Inventor: Naoki Nakatake, Hyougo (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 12/400,086

(22) Filed: Mar. 9, 2009

(65) Prior Publication Data

US 2009/0238617 A1 Sep. 24, 2009

(30) Foreign Application Priority Data

Mar. 18, 2008 (JP) ..... 2008-070264

(51) Int. Cl.
*G03G 21/00* (2006.01)

(52) U.S. Cl. ..... 399/358; 399/111; 399/120; 399/123

(58) Field of Classification Search ..... 399/107, 399/111, 119, 120, 123, 343, 358, 359
See application file for complete search history.

(56) References Cited

U.S. PATENT DOCUMENTS

| | | | | |
|---|---|---|---|---|
| 6,418,297 | B1 * | 7/2002 | Yamatani et al. | 399/358 |
| 7,043,189 | B2 * | 5/2006 | Blair et al. | 399/358 |
| 7,424,263 | B2 | 9/2008 | Shimizu et al. | |
| 7,693,477 | B2 * | 4/2010 | Chatani et al. | 399/358 |
| 2007/0104523 | A1 | 5/2007 | Yoshida et al. | |
| 2007/0248390 | A1 | 10/2007 | Kubota et al. | |
| 2008/0019720 | A1 | 1/2008 | Kawakami et al. | |
| 2008/0089727 | A1 | 4/2008 | Shimizu et al. | |
| 2008/0095559 | A1 | 4/2008 | Shimizu et al. | |
| 2008/0145108 | A1 | 6/2008 | Yoshida et al. | |
| 2008/0145109 | A1 | 6/2008 | Murayama et al. | |
| 2008/0145119 | A1 | 6/2008 | Tatsumi et al. | |
| 2008/0152408 | A1 | 6/2008 | Kawakami et al. | |
| 2008/0170898 | A1 | 7/2008 | Shimizu et al. | |
| 2008/0181692 | A1 | 7/2008 | Tatsumi et al. | |
| 2008/0187358 | A1 | 8/2008 | Kubota et al. | |
| 2008/0205930 | A1 | 8/2008 | Kawakami et al. | |
| 2008/0219698 | A1 | 9/2008 | Shimizu et al. | |
| 2008/0267661 | A1 | 10/2008 | Yoshida et al. | |
| 2008/0279586 | A1 | 11/2008 | Tatsumi et al. | |

FOREIGN PATENT DOCUMENTS

| | | |
|---|---|---|
| JP | 1-327397 | 11/1999 |
| JP | 11-327397 | 11/1999 |
| JP | 2005-43415 | 2/2005 |
| JP | 2005-91904 | 4/2005 |
| JP | 2006-195349 | 7/2006 |

* cited by examiner

*Primary Examiner*—Hoan Tran
(74) *Attorney, Agent, or Firm*—Dickstein Shapiro LLP

(57) ABSTRACT

A waste-toner conveying device includes a conveying unit that conveys foreign matter accumulated inside a container in a conveying path and that includes a coil unit, and a driving unit that drives the conveying unit to rotate. The coil unit includes a first coil on an upstream side and a second coil on a downstream side in a conveying direction, and the first coil and the second coil are connected in an eccentric manner.

12 Claims, 3 Drawing Sheets

WASTE-TONER CONVEYING DEVICE, CLEANING DEVICE, AND PROCESS CARTRIDGE

CROSS-REFERENCE TO RELATED APPLICATIONS

The present application claims priority to and incorporates by reference the entire contents of Japanese priority document 2008-070264 filed in Japan on Mar. 18, 2008.

BACKGROUND OF THE INVENTION

1. Field of the Invention

The present invention relates to a technology for conveying waste toner scraped from a surface of a target surface to be cleaned to a waste-toner collecting container in an image forming apparatus.

2. Description of the Related Art

An electrophotographic method has been widely used in an image forming apparatus such as a printer, which is connected to a personal computer, etc., and a facsimile. In recent years, a digital recording technology is applied not only to the printer but also to a typical copier, and a progress has been made in development of a digital copier. Therefore, a demand for the digital copier is expected to increase more and more. Such a digital copier is desired to have a compact size and to form high quality images at high speed considering an enhancement of efficiency in an office environment. Furthermore, the digital copier is desired to have a long lifetime for reducing a burden on the environment. Meanwhile, colorization of the image forming apparatus has been progressing, such as a color copier and a color printer.

A color electrophotographic apparatus of a revolver type or a tandem type is widely used. The revolver-type electrophotographic apparatus includes a plurality of developing units for a plurality of different colors around a single photosensitive element, and form a color image by forming a color toner image on the photosensitive element and transferring the toner image onto a recording medium such as a print sheet. The tandem-type electrophotographic apparatus includes developing units for respective photosensitive elements arranged in line, and forms a color image by forming a toner image of a different color on each of the photosensitive elements and sequentially transferring toner images on a recording medium in a superimposed manner.

The revolver-type electrophotographic apparatus includes only one photosensitive element, so that a relatively compact apparatus can be achieved. However, the toner images need to be formed on the photosensitive element in order in a plurality of stages, so that the revolver type is disadvantageous in high-speed image formation. On the other hand, although the size of the tandem-type electrophotographic apparatus is relatively larger, it is advantageous in high-speed image formation. Because the color image forming apparatus is desired to form an image at a speed similar to the speed of a monochromatic image forming apparatus, the tandem-type image forming apparatus is attracting more attention. A photosensitive element having a smaller diameter is often used to reduce the size of the image forming apparatus, which however constrains the layout of the apparatus, i.e., other units such as charging units, developing units, cleaning units, and an intermediate transfer device also need to be reduced in size. Therefore, the image forming apparatus is required to function effectively regardless of the size thereof.

The tandem-type image forming apparatus is shown in FIG. 7 as an example. In the tandem-type image forming apparatus, toner images of black (Bk), cyan (C), magenta (M), and yellow (Y) are sequentially transferred onto an intermediate transfer belt. Because an operation of forming a toner image is virtually the same for each color, the operation for forming the black toner image is explained as a representative. The tandem-type image forming apparatus includes an image carrier 1 (including four image carriers for four colors of Bk, C, M, and Y), a charging unit 2 (including four charging units for Bk, C, M, and Y), a developing unit 4 (including four developing units for Bk, C, M, and Y) in which a developer 5 is contained, an intermediate transfer belt 6, a transfer roller 7 (including four transfer rollers for Bk, C, M, and Y) arranged across the intermediate transfer belt 6, a secondary transfer unit 8, and a fixing unit 9. The charging unit 2 uniformly charges a surface of the image carrier 1. An exposure optical system emits a laser beam 3 to expose the surface of the image carrier 1, thus forming an electrostatic latent image on the image carrier 1. The developer 5 in the developing unit 4 is conveyed onto the surface of the image carrier 1 to develop the latent image into a visible image (toner image). The toner image on the surface of the image carrier 1 is transferred onto a surface of the intermediate transfer belt 6 at a nip portion at which the transfer roller 7 is in pressure contact with the image carrier 1 with the intermediate transfer belt 6 sandwiched therebetween. In the similar manner, a cyan toner image, a magenta toner image, and a yellow toner image are transferred onto the surface of the intermediate transfer belt 6 in a superimposed manner, so that a color toner image is formed on the surface of the intermediate transfer belt 6. The color toner image is transferred onto a recording medium at the secondary transfer unit 8. Then, the recording medium with the color toner image transferred thereon is conveyed to the fixing unit 9 at which the color toner image is fixed to the recording medium. The developer 5 remaining on the surface of the image carrier 1 after the transfer is removed by a cleaning blade 11 arranged in a cleaning device 10 for the subsequent image formation. Waste toner that is scraped by the cleaning blade 11 is conveyed and stored in a waste-toner storage container (not shown).

In the image forming apparatus, for reducing a cost, a one-component toner, which is relatively not expensive, is often used as material for the developer. The one-component toner has low melting point for forming a high-quality image at high speed and is applied with an external additive such as silica for enhancing handling capability. When using the toner, if toner particles get accumulated in a waste-toner conveying path, the toner particles may adhere to each other and become agglomerated, so that, a so-called blocking may occur. Especially, in the waste-toner conveying path, because deteriorated toner particles get accumulated, the toner particles are highly likely to become agglomerated, thus causing the blocking. This results in failure in operation of the image forming apparatus, which may lead to a breakdown of the apparatus.

For enhancing conveyability of the waste toner, a waste-toner conveying device is generally configured such that a waste-toner collecting container is arranged at a lower side of the waste-toner conveying path and the waste toner is collected by gravity or an external force is applied for collecting the waste toner. However, in the recent image forming apparatuses, such as a copier, a printer, etc., that use the electrophotographic method, for ensuring a high image quality, colorization, and downsizing of the apparatus, the internal configuration of the image forming apparatus is becoming more complex. Due to this, arranging the waste-toner collecting container in the lower portion of the waste-toner conveying path for the waste toner after cleaning is becoming difficult.

Therefore, a conveying unit for conveying the waste toner that is scraped during the cleaning to a collecting unit needs to be arranged at a different position.

Especially, toner particles become agglomerated more not only because of the use of the toner having the characteristics mentioned earlier but also because of the physical deterioration of the toner by repeatedly performing image formation and the thermal degradation of properties of the toner due to a temperature rise inside the image forming apparatus by heat transmission mainly from the fixing unit. Due to this, the toner may accumulate inside the conveying path, which causes clogging of the toner in the conveying path. To overcome the drawbacks mentioned earlier, various technologies have been proposed.

In a technology disclosed in Japanese Patent Application Laid-open No. 2005-43415, a cleaning hole is formed in the conveying path for cleaning the inside of the conveying path. In a technology disclosed in Japanese Patent Application Laid-open No. H11-327397, a scraping unit is arranged on a screw inside the conveying path to improve efficiency in conveying the toner, thus preventing clogging of the toner.

However, in the technology disclosed in Japanese Patent Application Laid-open No. 2005-43415, a user needs to frequently clean the inside of the conveying path. Moreover, the toner scatters while cleaning, which is problematic for environmental safety. In the technology disclosed in Japanese Patent Application Laid-open No. H11-327397, because the scraping unit is additionally needed, the number of components increases and abnormal noise may occur due to imparting of shock caused by the scrapping action.

SUMMARY OF THE INVENTION

It is an object of the present invention to at least partially solve the problems in the conventional technology.

According to one aspect of the present invention, there is provided a waste-toner conveying device including a conveying unit that conveys foreign matter accumulated inside a container in a conveying path and that includes a coil unit including a first coil on an upstream side and a second coil on a downstream side in a conveying direction, the first coil and the second coil being connected in an eccentric manner; and a driving unit that drives the conveying unit to rotate.

Furthermore, according to another aspect of the present invention, there is provided a cleaning device including a container in which foreign matter is accumulated; a waste-toner conveying device that includes a conveying unit that conveys the foreign matter accumulated inside the container in a conveying path and that includes a coil unit including a first coil on an upstream side and a second coil on a downstream side in a conveying direction, the first coil and the second coil being connected in an eccentric manner, and a driving unit that drives the conveying unit to rotate; and a cleaning unit that scrapes the foreign matter that is adhering to a target surface to be cleaned.

Moreover, according to still another aspect of the present invention, there is provided a process cartridge including a cleaning device that includes a container in which foreign matter is accumulated; a waste-toner conveying device that includes a conveying unit that conveys the foreign matter accumulated inside the container in a conveying path and that includes a coil unit including a first coil on an upstream side and a second coil on a downstream side in a conveying direction, the first coil and the second coil being connected in an eccentric manner, and a driving unit that drives the conveying unit to rotate; and a cleaning unit that scrapes the foreign matter that is adhering to a target surface to be cleaned.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are explained below with reference to the accompanying drawings. However, contents of the embodiments described herein are merely explained as an example, and the present invention is not to be thus limited.

Figure 1:
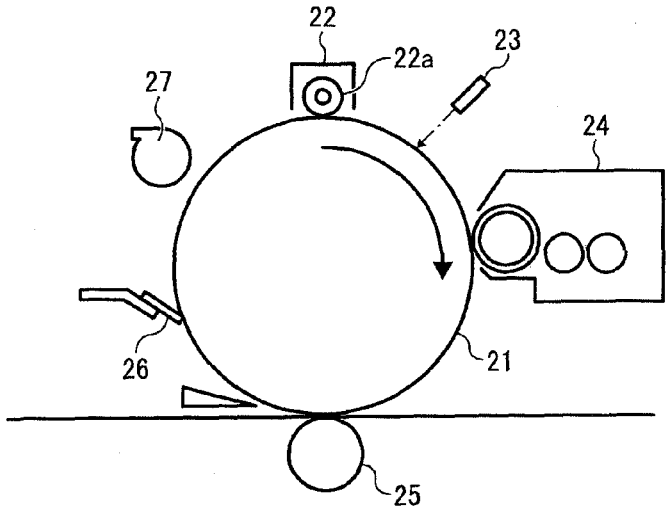
FIG. 1 is a schematic diagram of a photosensitive element and its peripherals of an image forming apparatus according to an embodiment of the present invention.

FIG. 1 is a schematic diagram of a photosensitive element 21 as an image carrier and its peripherals of an image forming apparatus according to an embodiment of the present invention. As shown in FIG. 1, the image forming apparatus includes the photosensitive element 21, a charging unit 22, an exposing unit 23, a developing unit 24, a transfer unit 25, a cleaning unit 26, and a neutralizing unit 27. The charging unit 22, the exposing unit 23, the developing unit 24, the transfer unit 25, the cleaning unit 26, and the neutralizing unit 27 are sequentially arranged around the photosensitive element 21. The charging unit 22 charges a surface of the photosensitive element 21. The exposing unit 23 forms a latent image on the charged surface of the photosensitive element 21. The developing unit 24 causes charged toner to adhere to the latent image formed on the surface of the photosensitive element 21, thereby forming a toner image. The transfer unit 25 transfers the toner image formed on the photosensitive element 21 onto a transfer target member. The cleaning unit 26 removes residual toner on the photosensitive element 21. The neutralizing unit 27 neutralizes the surface of the photosensitive element 21. The photosensitive element 21 and its peripherals are housed in a process cartridge.

In the structure mentioned earlier, when carrying out image formation by a negative-positive method in which the electric potential of an exposed portion is reduced to cause the toner to adhere to the latent image on the surface of the photosensitive element 21, the photosensitive element 21 causes a charging roller 22*a* of the charging unit 22 to uniformly charge the surface the photosensitive element 21 negatively and causes the exposing unit 23 to form an electrostatic latent image on the surface of the photosensitive element 21. Next, the photosensitive element 21 causes the developing unit 24 to adhere the toner to the surface of the photosensitive element 21, thus developing the electrostatic latent image into a toner image. The transfer unit 25 that includes a transfer belt transfers the toner image onto a recording sheet such as a printing sheet that is conveyed from a sheet feeding tray. During the transfer, the recording sheet that is electrostatically attracted to the photosensitive element 21 is separated from the photosensitive element 21 by a separating pawl. A fixing unit fixes the toner image to the recording sheet. The toner that remains on the photosensitive element 21 without getting transferred is removed by the cleaning unit 26 and is collected. After removal of the residual toner, a neutralizing lamp of the neutralizing unit 27 emits a light to neutralize the photosensitive element 21, thus preparing for the subsequent image forming process.

Figure 2:
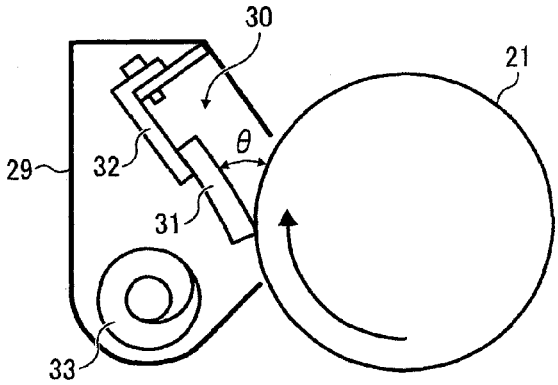
FIG. 2 is a schematic diagram of a cleaning device of the image forming apparatus according to the embodiment.

FIG. 2 is a schematic diagram of the cleaning unit 26 according to the present embodiment. For scraping and removing the toner that is adhering to the photosensitive element 21, the cleaning unit 26 includes a toner collecting container 29 and a conveying coil 33 that works as a screw. The toner that is scraped from the surface of the photosensitive element 21 by a cleaning blade 30 is conveyed by the conveying coil 33 that is rotatably supported inside the toner collecting container 29 and is collected as waste toner. As shown in FIG. 2, the cleaning blade 30 is fixed to the toner collecting container 29, thus exerting a pressure force on the photosensitive element 21. However, an external force such as spring pressure can also be added as a pressurizing unit.

The cleaning blade 30 includes a plate-shaped elastic blade 31 and a supporting unit 32 that supports the elastic blade 31. The elastic blade 31 is joined to the supporting unit 32 in a longitudinal direction. A tip of the elastic blade 31 on a free end side opposite a joining surface with the supporting unit 32 is in pressure contact with the surface of the photosensitive element 21 at a predetermined contact angle θ.

Figure 3:
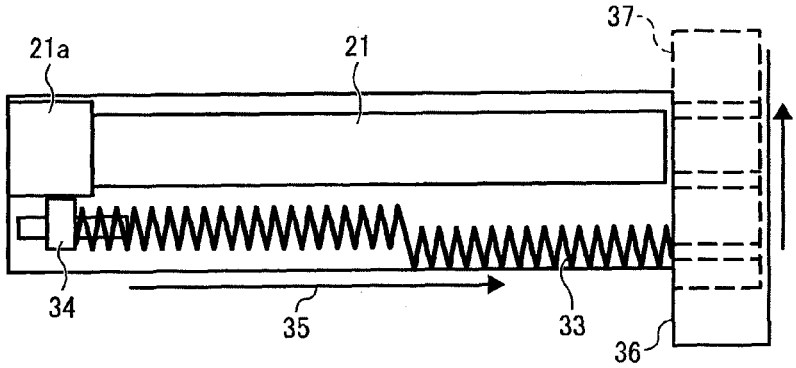
FIG. 3 is a schematic diagram of a waste-toner conveying device of the image forming apparatus according to the embodiment.
Figure 4:
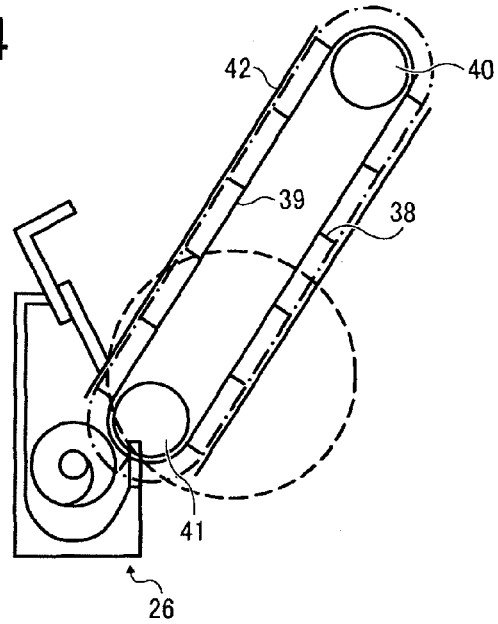
FIG. 4 is a schematic diagram of a second waste-toner conveying device of the image forming apparatus according to the embodiment.

Next, a waste-toner conveying device is explained in detail. FIG. 3 is a schematic diagram of the waste-toner conveying device according to the present embodiment. As shown in FIG. 3, the cleaning unit 26 includes in an upper portion, a waste-toner collecting container (not shown) (different from the toner collecting container 29). For conveying the waste toner scraped by the cleaning blade 30 and collected inside the toner collecting container 29 in a longitudinal direction, the spiral conveying coil 33 is supported on one side by a supporting unit 34. When carrying out an image forming operation, the conveying coil 33 is driven to rotate via a driving gear 21*a* of the photosensitive element 21 and other gears. Due to this, the waste toner can be conveyed in an axial direction 35 without necessitating extra space and with less amount of energy. Alternatively, the conveying coil 33 can be driven to rotate by providing a motor or the like. The waste toner that is conveyed in the axial direction 35 is temporarily stored in an intermediate buffer 36. The toner that is temporarily stored in the intermediate buffer 36 is collected in the waste-toner collecting container set in the upper portion by a second waste-toner conveying device 37 that includes a conveying belt member as shown in FIG. 4.

Next, the second waste-toner conveying device 37 is explained in detail. FIG. 4 is a schematic diagram of the second waste-toner conveying device 37 according to the present embodiment. As shown in FIG. 4, for conveying the waste toner that is temporarily collected in the intermediate buffer 36 to the waste-toner collecting container, a conveying belt 39 is arranged that includes a feather-shaped fin 38 and that is mainly formed of an elastic endless belt. The conveying belt 39 is supported by an upper end shaft 40 and a lower end shaft 41. The conveying belt 39 rotates due to rotation of the shafts 40 and 41, so that the fin 38 scoops up the waste toner from the intermediate buffer 36 and conveys the waste toner upward. The waste toner is collected inside the waste-toner collecting container. For ensuring that the toner does not fall while conveying the waste toner through a gap between the tip of the fin 38 and a housing outer wall 42 that houses the fin 38, the fin 38 is preferably in contact with the housing outer wall 42 for enhancing conveyability of the waste toner. However, it suffices that the fin 38 is arranged close to the housing outer wall 42.

FIGS. 5A to 5D are schematic diagrams of examples of a structure of the conveying coil 33 according to the present embodiment. The conveying coil 33 is formed of a spiral member that is processed by forming a linear-shaped member made of, for example, metal into a spiral shape. A metallic material such as stainless used steel (SUS), aluminium, phosphor bronze can be used as the material of the conveying coil 33. However, because agglomerating property of toner can be eased for material having weak adherence to the waste toner, using resin material such as plastic enables to prevent clogging of the waste toner more effectively. Moreover, adhesion of the waste toner to the conveying coil 33 can be suppressed more efficiently by coating the surface of the conveying coil 33 with Teflon (registered trademark), thereby enhancing clogging more efficiently.

Figure 5A:
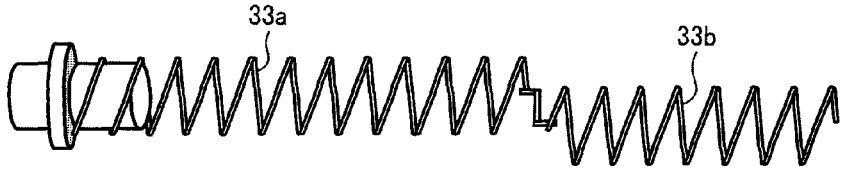
FIGS. 5A to 5D are schematic diagrams of examples of a structure of a conveying coil of the waste-toner conveying device.
Figure 6:
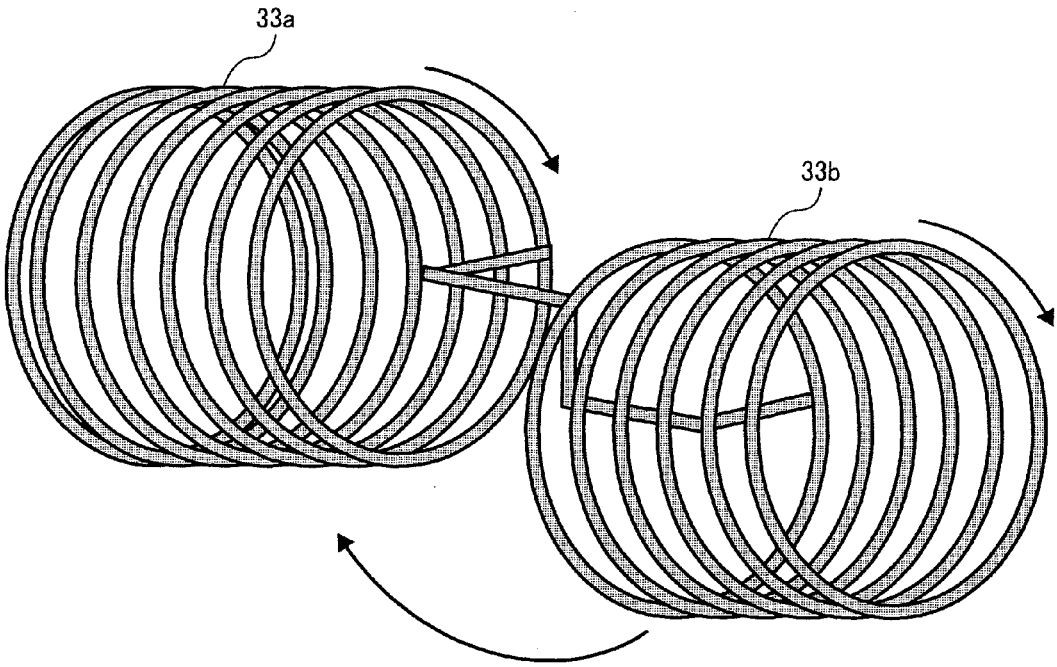
FIG. 6 is a schematic diagram of the conveying coil shown in FIGS. 5A to 5D.
Figure 7:
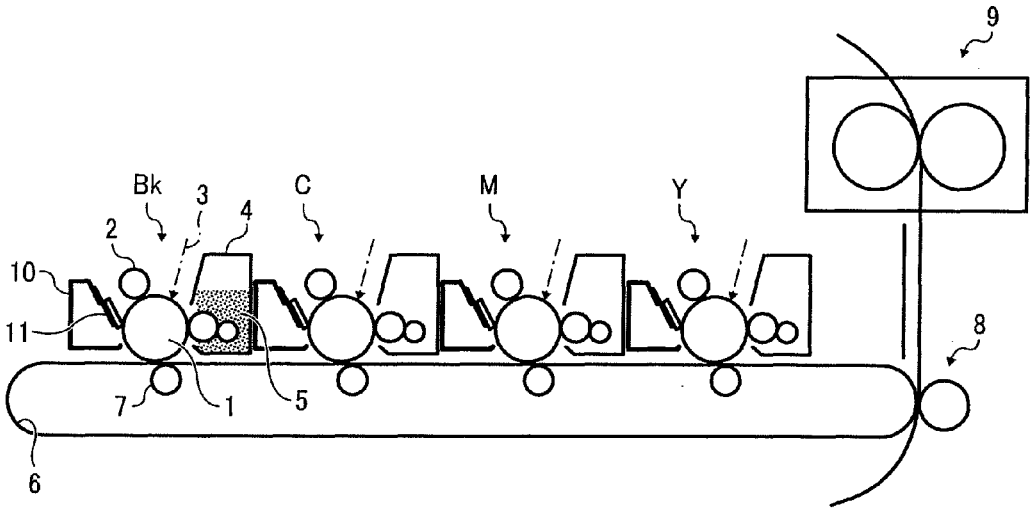
FIG. 7 is a schematic diagram of a typical tandem-type image forming apparatus.

As shown in FIG. 5A, the conveying coil 33 includes an upstream coil 33*a* and a downstream coil 33*b* connected in an eccentric manner at approximately the middle of the conveying coil 33 in a waste-toner conveying direction so that the upstream coil 33*a* and the downstream coil 33*b* rotate around a shaft of the supporting unit 34. As shown in FIG. 6, when the upstream coil 33*a* rotates, the downstream coil 33*b* also rotates along with the upstream coil 33*a*, so that the entire conveying coil 33 rotates. The waste toner accumulates and is solidified as it is conveyed to a downstream side in the conveying direction; however, the toner accumulated on the downstream side can be agitated by the rotation of the conveying coil 33, so that the conveying coil 33 can convey the toner while breaking the agglomerated toner. Thus, the waste toner can be conveyed efficiently. A position at which the upstream coil 33*a* and the downstream coil 33*b* are connected is not limited to approximately the middle point in the conveying direction. Moreover, the waste toner can be conveyed more efficiently by using a coil of a larger outer diameter because more waste toner can be conveyed inside of the coil.

Figure 5B:
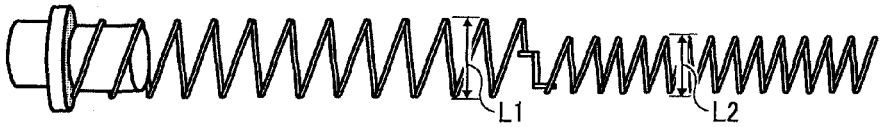

If the conveying coil 33 is arranged such that the upstream coil 33*a* and the downstream coil 33*b* are connected in an eccentric manner as shown in FIG. 5A, a space is required for the rotation of the downstream coil 33*b*. Due to this, a gap equivalent to the space occurs between the upstream coil 33*a* and the inner wall of the conveying path. If the waste toner remains in the space, the remained waste toner cannot be conveyed by the conveying coil 33, thus resulting in clogging. To overcome the drawback, as shown in FIG. 5B, the upstream coil 33*a* and the downstream coil 33*b* are configured to satisfy L1>L2, where L1 is an outer diameter of the upstream coil 33*a* and L2 is an outer diameter of the downstream coil 33*b*. In such configuration, it is possible to prevent accumulation of the waste toner in the conveying path, enabling to maintain high conveyability of the waste toner. For preventing accumulation of the waste toner inside the conveying path and for securing stability of rotation of the conveying coil 33, the conveying coil 33 is preferably close to the inner wall of the conveying path as much as possible.

Figure 5C:
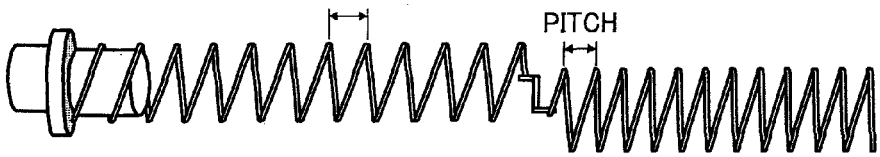

As shown in FIG. 5C, for efficiently agitating the waste toner on the downstream side of the conveying path, a fine winding pitch of the conveying coil 33 is desirable for reducing the amount of the waste toner that slips through a pitch gap. In the present embodiment, the pitch is changed in two stages in the conveying direction. However, the present invention is not to be thus limited, and the pitch can be reduced gradually along the conveying direction.

Figure 5D:
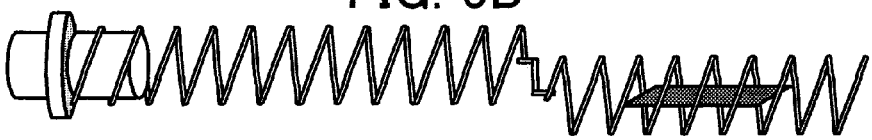

As shown in FIG. 5D, for reliably agitating the waste toner that is accumulated inside the conveying path, a plate-shaped member 43 can be arranged inside the downstream coil 33*b*. The plate-shaped member 43 enables to reduce agglomeration of the toner that slips through the pitch gap of the conveying coil 33. Thus, the accumulated waste toner can be reliably conveyed by using a method capable of keeping the fluidity of the waste toner.

For confirming effects of the present embodiment, an experiment was performed by using a tandem-type image forming apparatus for A4 size sheet. Two coils were prepared as a waste-toner conveying mechanism for conveying the waste toner, to be arranged in the longitudinal direction in a lower portion of a photosensitive element and a cleaning blade that cleaned the photosensitive element. Both of the coils were formed of SUS and had a diameter of 7 millimeters [mm] and a pitch of 3 mm; however, one is processed so that an upstream coil and a downstream coil are connected in an eccentric manner as shown in FIGS. 5A to 6 at a position of 60 mm from an end of the downstream side in the conveying direction, and the other one had one fixed coil axis. The coil was driven to rotate via a driving gear of the photosensitive element. The toner that was used included a parent toner having an average grain diameter of 9 micrometers [μm] to which a silica component of a different grain diameter was added by mixing. Sheets were continuously passed during an intermittent mode to form a single image having a printed area ratio of 5% under an environment of 27° C. temperature and 80% relative humidity (RH), and a status of conveying the waste toner was compared for the two coils.

When using the coil having one fixed coil axis, the waste toner caused blocking in the vicinity of a conveying path outlet after printing of 4000 sheets. The conveying coil was bent with a strong abnormal noise and was locked. However, when using the conveying coil according to the present embodiment in which the upstream side and on the downstream side are connected in an eccentric manner, the waste toner did not clog even after printing of 6000 sheets, thus indicating excellent conveyability of the waste toner.

Exemplary embodiments according to the present invention are explained. However, the invention in its broader aspects is not limited to the specific details and representative embodiments shown and described herein. Accordingly, various modifications may be made without departing from the spirit or scope of the general inventive concept as defined by the appended claims and their equivalents.

According to an aspect of the present invention, solidification of the waste toner due to agglomeration of the accumulated toner in the vicinity of a waste-toner conveying outlet can be suppressed, thereby preventing clogging or blocking of the toner in a conveying path.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A waste-toner conveying device comprising:

a conveying unit that conveys foreign matter accumulated inside a container in a conveying path and that includes a coil unit including a first coil on an upstream side and a second coil on a downstream side in a conveying direction, the first coil and the second coil being connected in an eccentric manner; and a driving unit that drives the conveying unit to rotate.

2. The waste-toner conveying device according to claim 1, wherein the conveying unit includes a plate member arranged in the coil unit.

3. The waste-toner conveying device according to claim 1, wherein a diameter of the second coil is equal to or smaller than that of the first coil.

4. The waste-toner conveying device according to claim 1, wherein a winding pitch of the first coil is different from that of the second coil.

5. The waste-toner conveying device according to claim 1, wherein a winding pitch of the coil unit gradually decreases towards the downstream side.

6. The waste-toner conveying device according to claim 1, wherein the second coil is in contact with an inner wall forming the conveying path.

7. The waste-toner conveying device according to claim 1, wherein the coil unit is made of resin.

8. The waste-toner conveying device according to claim 1, wherein the driving unit obtains a driving force from another driving unit via a driving gear.

9. A cleaning device comprising:

a container in which foreign matter is accumulated;

a waste-toner conveying device that includes a conveying unit that conveys the foreign matter accumulated inside the container in a conveying path and that includes a coil unit including a first coil on an upstream side and a second coil on a downstream side in a conveying direction, the first coil and the second coil being connected in an eccentric manner, and a driving unit that drives the conveying unit to rotate; and a cleaning unit that scrapes the foreign matter that is adhering to a target surface to be cleaned.

10. An image forming apparatus comprising the cleaning device according to claim 9.

11. An electrophotographic apparatus comprising the cleaning device according to claim 9.

12. A process cartridge comprising a cleaning device that includes a container in which foreign matter is accumulated;

a waste-toner conveying device that includes a conveying unit that conveys the foreign matter accumulated inside the container in a conveying path and that includes a coil unit including a first coil on an upstream side and a second coil on a downstream side in a conveying direction, the first coil and the second coil being connected in an eccentric manner, and a driving unit that drives the conveying unit to rotate; and a cleaning unit that scrapes the foreign matter that is adhering to a target surface to be cleaned.

* * * * *